US008991074B2

(12) United States Patent
Ivester et al.

(10) Patent No.: US 8,991,074 B2
(45) Date of Patent: Mar. 31, 2015

(54) FOOTWEAR LACING SYSTEM

(75) Inventors: Richard G. Ivester, Nashville, TN (US); Kevin Fisher, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 499 days.

(21) Appl. No.: 13/314,944

(22) Filed: Dec. 8, 2011

(65) Prior Publication Data

US 2012/0151795 A1 Jun. 21, 2012

Related U.S. Application Data

(60) Provisional application No. 61/423,767, filed on Dec. 16, 2010.

(51) Int. Cl.

| | |
|---|---|
| ***A43C 1/00*** | (2006.01) |
| ***A43C 1/06*** | (2006.01) |
| *A43C 9/00* | (2006.01) |

(52) U.S. Cl.

CPC . *A43C 1/00* (2013.01); *A43C 1/006* (2013.01); *A43C 9/00* (2013.01); *A43C 1/06* (2013.01)

USPC ..... 36/50.1; 36/114

(58) Field of Classification Search

CPC ..... A43C 1/00; A43C 1/003; A43C 1/006; A43C 9/00; A43B 23/00

USPC ..... 36/50.1, 51, 115, 114

See application file for complete search history.

(56) References Cited

U.S. PATENT DOCUMENTS

| | | | | |
|---|---|---|---|---|
| D34,356 | S | 4/1901 | Hiller | |
| D35,875 | S | 4/1902 | Hiller | |
| 1,150,616 | A * | 8/1915 | Officer | 24/715.4 |
| 1,233,863 | A * | 7/1917 | Fry | 24/715.4 |
| 1,823,057 | A | 9/1931 | Marx | |
| 3,703,775 | A | 11/1972 | Gatti | |
| 4,622,763 | A * | 11/1986 | Adams | 36/50.1 |
| 5,659,982 | A | 8/1997 | Muraoka et al. | |
| 5,692,319 | A * | 12/1997 | Parker et al. | 36/50.1 |
| 6,513,210 | B1 * | 2/2003 | Gonzalez | 24/712 |
| D473,702 | S | 4/2003 | Burg et al. | |
| 6,757,991 | B2 | 7/2004 | Sussmann | |
| 7,401,423 | B2 * | 7/2008 | Reagan et al. | 36/50.1 |
| 2007/0033836 | A1 * | 2/2007 | Rasmussen | 36/50.1 |
| 2008/0066344 | A1 * | 3/2008 | Kelley | 36/50.1 |

FOREIGN PATENT DOCUMENTS

DE 8909016.0 U1 1/1990

* cited by examiner

*Primary Examiner* — Jila M Mohandesi

(74) *Attorney, Agent, or Firm* — Maginot, Moore & Beck LLP

(57) ABSTRACT

A shoe includes a shoe upper, a first lace and a second lace. The shoe upper includes a heel end, a toe end, and a mid-foot portion between the heel end and the toe end. The first lace is connected to the shoe upper and includes a wide portion and a narrow portion with a tapered portion in-between. The wide portion of the first lace is fastened to the mid-foot portion of the shoe upper at a first position that is nearer to the toe end than the heel end. The second lace is also connected to the shoe upper and also includes a wide portion and a narrow portion with a tapered portion in-between. The wide portion of the second lace is fastened to the mid-foot portion of the shoe upper at a second position that is nearer to the heel end than the first position.

14 Claims, 3 Drawing Sheets

FOOTWEAR LACING SYSTEM

FIELD

This application relates to the field of footwear, and particularly to footwear lacing systems.

BACKGROUND

Various tightening systems for footwear are known in the art, including shoe lace arrangements and strap arrangements. These traditional tightening systems are used to tighten the upper portion of a shoe against the foot of the wearer. It is desirable for the tightening system to provide support for severe lateral movements made by the wearer, such as movements made during cross-training exercises. It is also desirable for the tightening system to be relatively lightweight with a low profile.

In traditional strap arrangements, relatively wide straps provide the advantage of support to the foot of the wearer, but tend to be bulky and somewhat heavy. These strap arrangements may rely on hook-and-loop fasteners (e.g., Velcro®) for closure, thus adding even more bulk to the strap arrangement. On the other hand, traditional shoe lace arrangements are lightweight and small, but do not provide the support offered by straps. Additionally, traditional shoe lace arrangements are easily loosened, and often need to be re-tightened during athletic activity. Accordingly, it would be advantageous to provide a tightening arrangement for footwear that is lightweight and low-profile while also offering substantial support to the foot of the wearer.

SUMMARY

In accordance with one embodiment of the disclosure, there is provided a shoe comprising a shoe upper, a first lace and a second lace. The shoe upper includes a heel end, a toe end, and a mid-foot portion between the heel end and the toe end. The first lace is connected to the shoe upper and includes a wide portion and a narrow portion. The wide portion of the first lace is fastened to the mid-foot portion of the shoe upper at a first position that is nearer to the toe end than the heel end. The second lace is also connected to the shoe upper and includes a wide portion and a narrow portion. The wide portion of the second lace is fastened to the mid-foot portion of the shoe upper at a second position that is nearer to the heel end than the first position.

In at least one embodiment, the first lace extends through a plurality of lacing eyelets positioned in or on the mid-foot portion of the shoe upper. The mid-foot portion of the shoe upper includes an instep portion comprising a central recess with a tongue positioned in the central recess. The plurality of lacing eyelets are positioned on opposite sides of the central recess. The second lace also extends through at least one of the plurality of lacing eyelets such that the first lace and the second lace cross on the instep portion of the shoe upper.

In at least one embodiment, both the first lace and the second lace include a tapered portion that connects the wide portion of the lace to the narrow portion. The first lace extends through the plurality of lacing eyelets such that the tapered portion of the first lace extends through a final first side eyelet of the plurality of eyelets. Likewise the second lace extends through the at least one of the plurality of lacing eyelets such that the tapered portion of the second lace extends through a final second side eyelet of the plurality of eyelets.

In at least one embodiment, the shoe further comprises a first side support member that extends from an outsole of the shoe to the mid-foot portion of the shoe. At least one of the plurality of lacing eyelets is coupled to the first side support member at the mid-foot portion of the shoe. A second side support member extends from the outsole to the mid-foot portion of the shoe. The second lace is fastened to the second side support member on the mid-foot portion of the shoe.

The above described features and advantages, as well as others, will become more readily apparent to those of ordinary skill in the art by reference to the following detailed description and accompanying drawings. While it would be desirable to provide a shoe that provides one or more of these or other advantageous features, the teachings disclosed herein extend to those embodiments which fall within the scope of the appended claims, regardless of whether they accomplish one or more of the above-mentioned advantages.

DESCRIPTION

Figure 1:
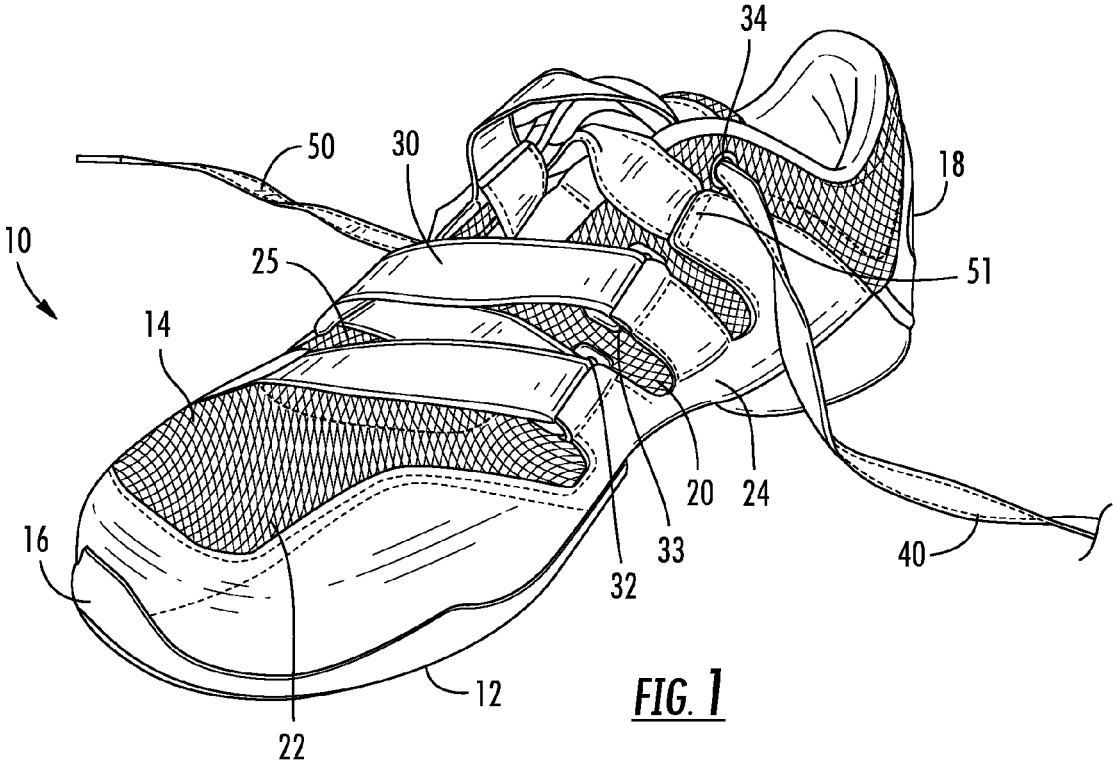
FIG. 1 shows a side perspective view of one embodiment of a shoe with tapered lacing system.
Figure 2:
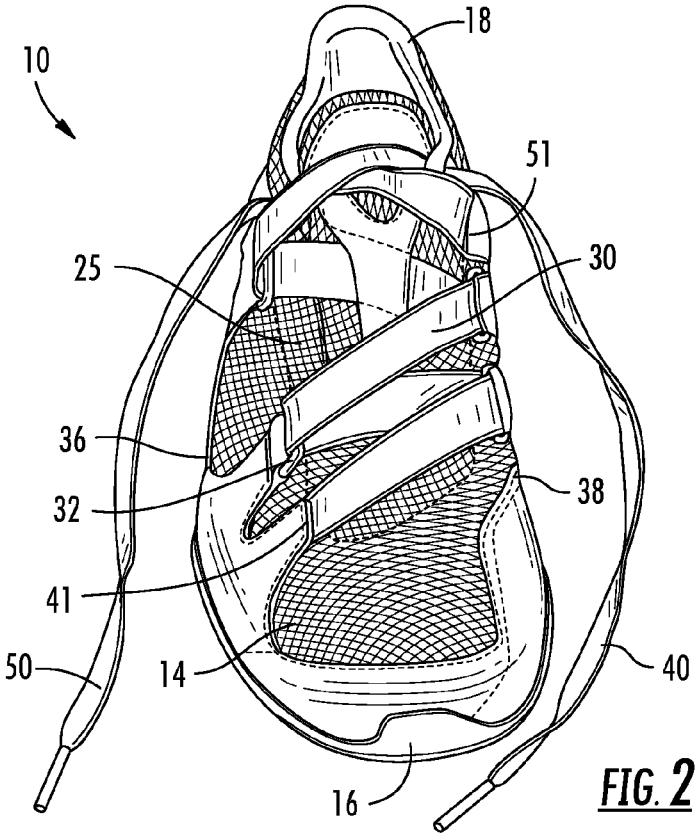
FIG. 2 shows a front perspective view of the shoe with tapered lacing system of FIG. 1.

With reference to FIGS. 1 and 2, an article of footwear in the form of a shoe 10 includes a sole 12 with a shoe upper 14 connected to the sole 12. The shoe upper 14 includes a toe end 16, a heel end 18, and a mid-foot portion 20 provided between the toe end 16 and the heel end 18. A shoe closure in the form of a lacing system 30 is positioned on the mid-foot portion of the shoe upper 14.

The sole 12 and the shoe upper 14 (which may also be referred to herein as simply an "upper") may be comprised of any of various materials known in the art, including, for example, textiles and polymeric materials, such as synthetic rubber. In the embodiment of FIG. 1, the shoe upper 14 includes textile portions 22 along with several different polymer portions 24. The textile portions 22 are generally lightweight and provide the shoe with flexibility and breathability. Exemplary textile materials include textiles comprised of polyester, nylon, or various other materials as will be recognized by those of ordinary skill in the art.

The polymer portions 24 are also relatively lightweight and provide the shoe with stability and durability. The polymer portions 24 may be formed in different ways, such as by molding or by cutting the polymer portions 24 from a sheet of polymeric material. In various embodiments, at least some section of the polymer portions 24 may extend completely to the sole and be directly connected to the sole 12. In other embodiments, different sections of the polymer portions 24 may be separated from the sole by the textile portions 22. Additionally, in alternative embodiments, the polymer portions 24 may be substituted for a different material, such as a leather material or a different textile than the textile portions 22.

The mid-foot portion 20 of the upper 14 includes an instep portion 25. A central recess 26 is formed in the instep portion 25, and a tongue 28 is positioned in the central recess 26. One end of the tongue 28 is fastened to the upper 14 closer to the toe end 16. The opposite end of the tongue 28 is moveable within the central recess 26.

With reference again to FIGS. 1-3, the lacing system 30 is provided on the mid-foot portion 20 of the upper 14, and particularly on the instep portion 25. The lacing system 30 includes a first lace 40 and a second lace 50 that extend through a plurality of lacing eyelets 32 fastened to the mid-foot portion 20 of the shoe 10. The plurality of lacing eyelets 32 are generally positioned on opposite sides of the recess 26 on the instep 25. The lacing eyelets 32 may be provided in various forms, such as the rectangular shaped eyelets 33 pivotably fastened on the mid-foot portion 20, or eyelets 34 positioned in openings in the mid-foot portion 20. It will be recognized that these are only a few exemplary embodiments of numerous differently eyelets that may be utilized with the lacing system 30.

Figure 3:
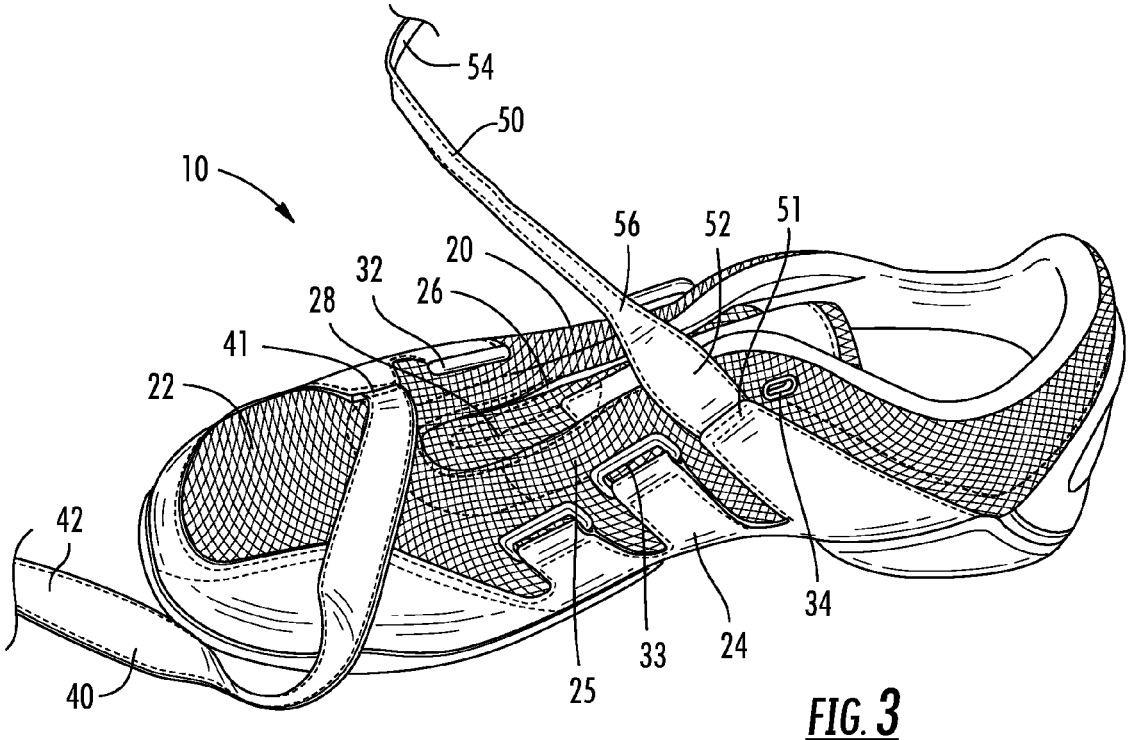
FIG. 3 shows a side perspective view of the shoe with tapered lacing system of FIG. 1 with laces removed from eyelets on the shoe.
Figure 4:
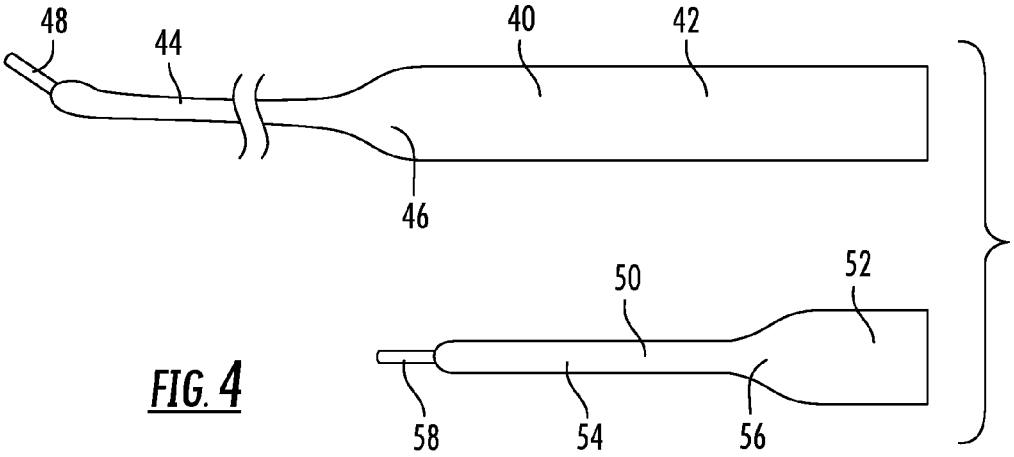
FIG. 4 illustrates a tapered configuration for the laces of the shoe of FIG. 1.

As best shown in FIG. 4, the first lace 40 includes a wide portion 42, a narrow portion 44, and a tapered portion 46 between the wide portion 42 and the narrow portion 44 of the first lace 40. An aglet 48 is positioned at the end of the narrow portion 44 of the first lace 40. The width of the first lace 40 is gradually reduced over the length of the tapered portion 46 from a first width provided at the wide portion 42 to a second width provided at the narrow portion 44. In some embodiments, the first width at the wide portion 42 of the first lace 40 is between 12 mm and 24 mm, and the second width at the narrow portion is between 5 mm and 10 mm. In the particular embodiment of FIGS. 1-4, the first width is about 18 mm and the second width is about 8 mm. While this is but one possible embodiment, it will be recognized that any number of different widths are possible for the first lace 40, including numerous different widths for both the wide portion 42 and the narrow portion 24. Additionally, the length of the first lace 40 is significantly greater than either the first width or the second width of the first lace 40.

With continued reference to FIG. 4, the second lace 50 is significantly shorter in length than the first lace 40. For example, in at least one embodiment, the second lace 50 is about 20 mm to 40 mm in length and the first lace 40 is about 50 mm to 70 mm in length. However, it will be recognized that the lengths disclosed herein are merely exemplary of the different lengths of the laces 40 and 50, and numerous other lengths are possible.

Similar to the first lace 40, the second lace 50 also includes a wide portion 52, a narrow portion 54, and a tapered portion 56 between the wide portion 52 and the narrow portion 54 of the second lace 50. An aglet 58 is positioned at the end of the narrow portion 54 of the second lace 50. The width of the second lace 50 is gradually reduced over the length of the tapered portion 56 from a first width provided at the wide portion 52 to a second width provided at the narrow portion 54. Again, in some embodiments, the first width at the wide portion 52 of the second lace 50 is between 12 mm and 24 mm, and the second width at the narrow portion 54 of the second lace is between 5 mm and 10 mm. In the particular embodiment of FIGS. 1-4, the first width is about 18 mm, and the second width is about 8 mm. While this is but one possible embodiment, it will be recognized that any number of different widths are possible for the second lace 50. Additionally, the length of the second lace 50 is significantly greater than either the first width or the second width.

The laces 40, 50 may be comprised of any of various materials known to those of ordinary skill in the art. For example, the laces may be comprised of a cotton material or a more durable polyester material. In at least one embodiment, the laces are comprised of a nanofiber material that is generally lightweight and provides the lace with durability along with high surface area and shear gripping properties. Such a nanofiber lace is not tacky yet provides superior gripping qualities when wet. An "islands in the sea" technique may be used to create such a nanofiber material for the laces 40, 50 where fibers split and create over 250 filaments each. While standard microfiber yarn is 30 denier/36 filaments, nanofiber yarn may be provided that is 30 denier/8000 filaments. Accordingly, such nanofiber lace provides increased surface area that creates a high coefficient of friction when the laces are tied together. While nanofiber, polyester and cotton materials have been disclosed herein as exemplary materials for manufacturing the laces 40, 50, it will be recognized that any number of different materials may be used to create the laces 40, 50.

As best shown in FIG. 3, the wide portion 42 of the first lace 40 is non-removably fastened to the mid-foot portion 20 at a first fastening location provided at the lateral side 36 of the instep 25. This first fastening location 41 is closer to the toe end 16 of the shoe 10 than it is to the heel end 18 of the shoe 10. The second lace 50 is non-removably fastened to the mid-foot portion 20 at a second fastening location 51 provided at the medial side 38 of the instep 25. This second fastening location 51 is closer to the heel end 18 of the shoe than the first fastening location 41. In other words, the first fastening location 41 is substantially more forward on the shoe 10 toward the toe end 16 than the second fastening location 51, and the second fastening location 51 is more rearward on the shoe toward heel end 18 than the first fastening location 41. Accordingly, the first fastening location 41 for the first lace 40 and the second fastening location 51 for the second lace 50 are staggered from one another on the instep 25, and are not positioned directly across from one another. Although the laces 40, 50 are directly fastened to the shoe upper 14 in the embodiment disclosed herein, it will be recognized that in other embodiments, the laces 40, 50, need not be anchored directly to the shoe, or may be anchored to other locations on the shoe upper 14.

With reference again to FIGS. 1 and 2, the wide portion 42 of the first lace 40 extends through a plurality of lacing eyelets 32 positioned in or on the mid-foot portion 20 of the shoe upper 14. Accordingly, the wide portion 42 of the first lace 40 criss-crosses the central recess 26 as it moves from one lacing eyelet 32 to the next. The first lace 40 is designed and dimensioned such that the tapered portion 46 of the first lace 40 extends through the final lacing eyelet 32. Because the wide portion 42 of the first lace 40 weaves through the plurality of lacing eyelets 32, the lace offers substantial support to the instep of the wearer of the shoe. At the same time, the narrow portion 44 of the first lace 40 allows the wearer to easily grasp, manipulate, and tie the lace 40 in a manner that is customary with other lacing systems.

In contrast to the first lace 40 which weaves through most of the plurality of lacing eyelets 32, the second lace 50 only extends through one of the plurality of lacing eyelets 32 in the embodiment of FIGS. 1-4. In particular, the second lace 50 crosses the first lace 40 near the mouth of the recess 26, and extends through the final eyelet 34 on the medial side of the shoe upper 14. Similar to the first lace 40, the tapered portion 56 of the second lace is positioned on the shoe upper 14 such that it extends through the final eyelet 34. Accordingly, the wide portion 52 of the first lace offers substantial support to the instep of the wearer, while the narrow portion 54 allows the wearer to easily grasp, manipulate, and tie the lace 50.

Figure 5:
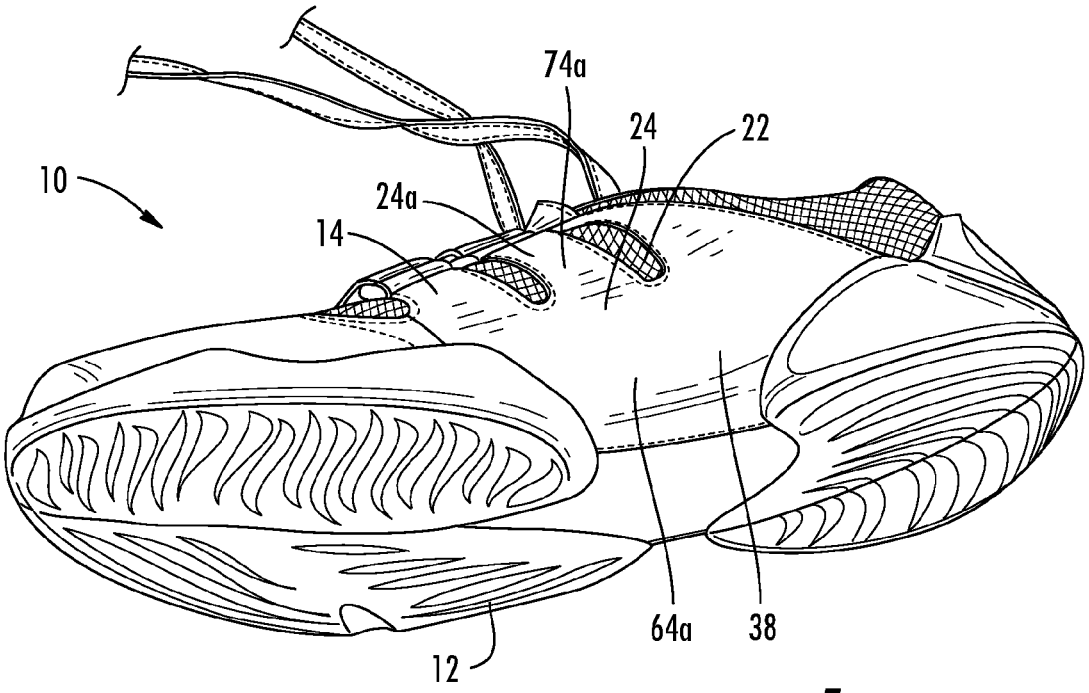
FIG. 5 shows a bottom medial perspective view of the shoe of FIG. 1.
Figure 6:
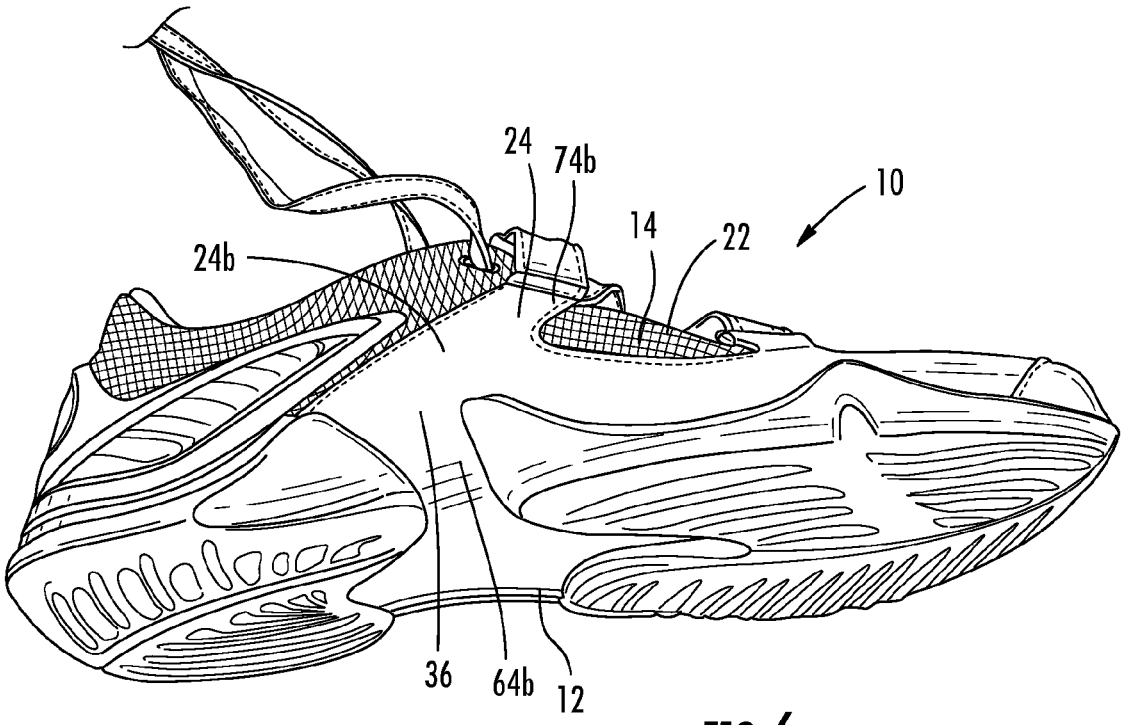
FIG. 6 shows a bottom lateral perspective view of the shoe of FIG. 1.

With reference now to FIGS. 5 and 6, in at least one embodiment, the plurality of lacing eyelets 32 include rectangular eyelets 33 that are pivotably coupled to the polymer portions 24 in the form of a medial side support member 24*a* and a lateral side support member 24*b*. The side support members 24*a* and 24*b* extend from the shoe upper 14 to the sole 12 such that the side support members 24*a* and 24*b* are directly connected to the sole 12. In the embodiment of FIGS. 5 and 6, the side support members 24*a* and 24*b* are integrally formed with the outsole of the shoe 10, with the medial side support member 24*a* connecting to the lateral side support member 24*b* on the bottom of the outsole. Medial side support member 24*a* includes a lower portion 64*a* with a plurality of fingers 74*a* extending upward from the lower portion 64*a*. The lower portion 64*a* is directly connected to the sole 12 along the substantial length of the midfoot portion 20. The plurality of fingers 74*a* extend upward from the lower portion 64*a* and an end of each finger is coupled to one of the lacing eyelets 32. Similarly, lateral side support member 24*b* includes a lower portion 64*b* with a fingers 74*b* extending upward from the lower portion 64*ba*. The lower portion 64*b* is directly connected to the sole 12 along the substantial length of the midfoot portion 20. The finger 74*b* extends upward from the lower portion 64*b* and the end of the finger is coupled to one of the lacing eyelets 32. Accordingly, when the first and second laces 40 and 50 are pulled tight and tied on the shoe 10, the lacing eyelets 32 tend to pull on the fingers 74*a* and 74*b* and associated lower portions 64*a* and 64*b* of the side support members 24*a* and 24*b* which extend all the way to the bottom of the shoe. This provides the wearer with increased compression and a snug fit in the midfoot portion 20 of the shoe 10. Moreover, because a relatively wide portion of the lace 50 engages each lacing eyelet 33, an increased pulling force may be provided over a wider area of the lacing eyelet 33 and the associated side support member. This not only enhances the compression effect, but also provides for additional durability in the laces, since a wider portion of the lace engages the lacing eyelets 33.

In operation, a wearer closes the shoe 10 on his or her foot by simply pulling the laces 40, 50 tight in the eyelets 32, and tying the narrow portions 42, 52 of the laces together. The wide portions 42, 52 of the laces 40, 50, allow the wearer to pull the laces 40, 50 very tight for a more secure fit than is offered by conventional lacing systems. Because the wide portions 42, 52 cover an increased area of the wearer's instep, they provide the wearer with strap-like support without the weight or bulk traditionally associated with shoe straps. Accordingly, the lacing system 30 provides the wearer with the convenience of light weight laces without the undue sharp pressure on the foot that is typically associated with laces. Additionally, the traditional tie arrangement is easy for the wearer to understand and implement.

The foregoing detailed description of one or more embodiments of the footwear lacing system has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by any appended claims. Therefore, the spirit and scope of any appended claims should not be limited to the description of the embodiments contained herein.

What is claimed is:

1. An article of footwear comprising:

an upper including a heel end, a toe end, and a mid-foot portion between the heel end and the toe end, the mid-foot portion of the upper including an instep portion comprising a central recess with a tongue positioned in the central recess;

a plurality of lacing eyelets positioned in or on the mid-foot portion of the upper, the plurality of lacing eyelets are positioned on opposite sides of the central recess;

a first lace connected to the upper, the first lace including a wide portion and a narrow portion, the wide portion fastened to the mid-foot portion of the upper at a first position that is nearer to the toe end than the heel end, the first lace extends through the plurality of lacing eyelets with the tapered portion of the first lace extending through a final first side eyelet of the plurality of eyelets and the wide portion of the first lace extending through other of the plurality of lacing eyelets; and a second lace connected to the upper, the second lace including a wide portion and a narrow portion, the wide portion fastened to the mid-foot portion of the upper at a second position that is nearer to the heel end than the first position, the second lace also extending through one of the plurality of lacing eyelets such that the first lace and the second lace cross the central recess on the instep portion of the upper, the second lace extending through at least one of the plurality of lacing eyelets such that the narrow portion of the second lace extends through a final second side eyelet of the plurality of eyelets.

2. The article of footwear of claim 1 wherein the first lace includes a tapered portion connecting the wide portion to the narrow portion, and wherein the second lace also includes a tapered portion connecting the wide portion to the narrow portion.

3. The article of footwear of claim 1 further comprising a first side support member that is integrally formed with an outsole and extends from the outsole to the mid-foot portion of the article of footwear, wherein at least one of the plurality of lacing eyelets is coupled to the first side support member at the mid-foot portion of the article of footwear.

4. The article of footwear of claim 3 further comprising a second side support member that is integrally formed with the outsole and extends from the outsole to the mid-foot portion of the article of footwear, wherein the second lace is fastened to the second side support member on the mid-foot portion of the article of footwear.

5. The article of footwear of claim 1 wherein the first lace is substantially longer than the second lace.

6. An article of footwear comprising:

an upper including a toe end and a heel end with an instep portion therebetween, the instep portion including a central recess with a tongue positioned in the central recess;

a plurality of eyelets provided on the upper, the plurality of eyelets including a first number of first eyelets and a second number of second eyelets, the first eyelets including a first final eyelet that is closer to the heel end than other of the first eyelets, the second number different from the first number;

a first lace coupled to the upper at a first location, the first lace extending through the first number eyelets, the first lace including a wide portion and a narrow portion wherein the wide portion extends through the first eyelets except for the first final eyelet, and the narrow end extends through the first final eyelet, the wide portion of the first lace extending across the central recess and tongue; and a second lace coupled to the upper at a second location, the second lace extending through the second eyelets, the second lace including a wide portion and a narrow portion wherein the narrow portion extends through the second final eyelet, the second number different than the first number.

7. The article of footwear of claim 6 further comprising a sole connected to the shoe upper and a plurality of side support members extending from the shoe upper to the sole, the side support members not extending to the central recess.

8. The article of footwear of claim 6 wherein the first final eyelet is differently shaped than other of the first eyelets.

9. The article of footwear of claim 6 wherein the first number is greater than four and the second number is less than four.

10. The article of footwear of claim 6 wherein the second number is one and the first number is greater than one.

11. The article of footwear of claim 6 wherein the second location is substantially closer to the heel end of the upper than the first location.

12. The article of footwear of claim 6 wherein an end of the first lace on the wide portion is coupled to the upper, and wherein an end of the first lace on the narrow portion is a free end.

13. An article of footwear comprising:

an outsole;

an upper connected to the outsole, the upper comprising a first portion comprised of a first material and a second portion comprised of a second material, the first portion directly connected to the outsole along the substantial length of a midfoot portion of the upper, the first portion including a lower portion integrally formed with the outsole with a plurality of fingers extending upward from the lower portion, the second portion including a central recess with a tongue positioned in the central recess;

a plurality of eyelets connected to the fingers of the first portion of the upper;

a first lace carried on the upper, the first lace including a wide portion and a narrow portion, the wide portion extending through the plurality of eyelets and across the central recess and the tongue, wherein an end of the wide portion of the first lace is fastened to the upper at a first location; and a second lace fastened to the upper at a second location.

14. The article of footwear of claim 13 wherein the second location is substantially closer to a toe end of the upper than the first location, and wherein the first lace is substantially longer than the second lace.

* * * * *